US011382832B2

(12) United States Patent
Timbal et al.

(10) Patent No.: US 11,382,832 B2
(45) Date of Patent: Jul. 12, 2022

(54) DIP TUBE

(71) Applicant: Novartis AG, Basel (CH)

(72) Inventors: Olivier Timbal, Basel (CH); Gesine Winzenburg, Basel (CH)

(73) Assignee: NOVARTIS AG, Basel (CH)

( * ) Notice: Subject to any disclaimer, the term of this patent is extended or adjusted under 35 U.S.C. 154(b) by 421 days.

(21) Appl. No.: 16/479,150

(22) PCT Filed: Jan. 5, 2018

(86) PCT No.: PCT/EP2018/050258
§ 371 (c)(1),
(2) Date: Jul. 18, 2019

(87) PCT Pub. No.: WO2018/134062
PCT Pub. Date: Jul. 26, 2018

(65) Prior Publication Data

US 2019/0388300 A1 Dec. 26, 2019

(30) Foreign Application Priority Data

Jan. 18, 2017 (EP) ..... 17151958

(51) Int. Cl.
*A61J 1/14* (2006.01)
*A61J 1/20* (2006.01)
*A61J 7/00* (2006.01)

(52) U.S. Cl.
CPC ..... *A61J 1/1487* (2015.05); *A61J 1/1418* (2015.05); *A61J 1/2075* (2015.05); *A61J 1/2096* (2013.01); *A61J 7/0053* (2013.01)

(58) Field of Classification Search
CPC ..... A61J 1/2096; A61J 1/1418; A61J 1/2075; A61J 7/0053
See application file for complete search history.

(56) References Cited

U.S. PATENT DOCUMENTS 3,873,274 A * 3/1975 Neisius ..... B01L 3/0206 422/75
4,081,111 A * 3/1978 Sandow ..... B05B 11/3001 222/309

(Continued)

FOREIGN PATENT DOCUMENTS

WO WO 2015/004410 A1 1/2015
WO WO 2016/149503 A1 9/2016

OTHER PUBLICATIONS

Novartis Pharmaceuticals Corporation, Exelon, Full prescribing information, Dec. 2018, 24 pages.

(Continued)

*Primary Examiner* — Timothy L Maust
(74) *Attorney, Agent, or Firm* — Moore & Van Allen PLLC; Henry B. Ward, III

(57) ABSTRACT

A dip tube (10) for extracting a fluid (102) from a bottle (104) comprises an adapter (12) configured to be at least partially inserted into a neck (106) of the bottle (104) and being provided with a connecting port (38) which is configured to be connected to a suction device (118), an elongated hollow withdrawal tube (14) which has a cross-sectional area that is smaller than a cross-sectional area of the adapter (12) and which is configured to protrude from the adapter (12) into a fluid receiving space (108) of the bottle (104), when the adapter (12) is inserted in the bottle neck (106), and which is arranged in fluid communication with the connecting port (38) of the adapter (12), and a sealing disc (52) extending from an outer circumferential surface (54) of the withdrawal tube (14) and being configured to abut against an inner surface (128) of the bottle (104) so as to seal the fluid receiving space (108) of the bottle (104).

21 Claims, 6 Drawing Sheets

(56) References Cited

Figure 1:
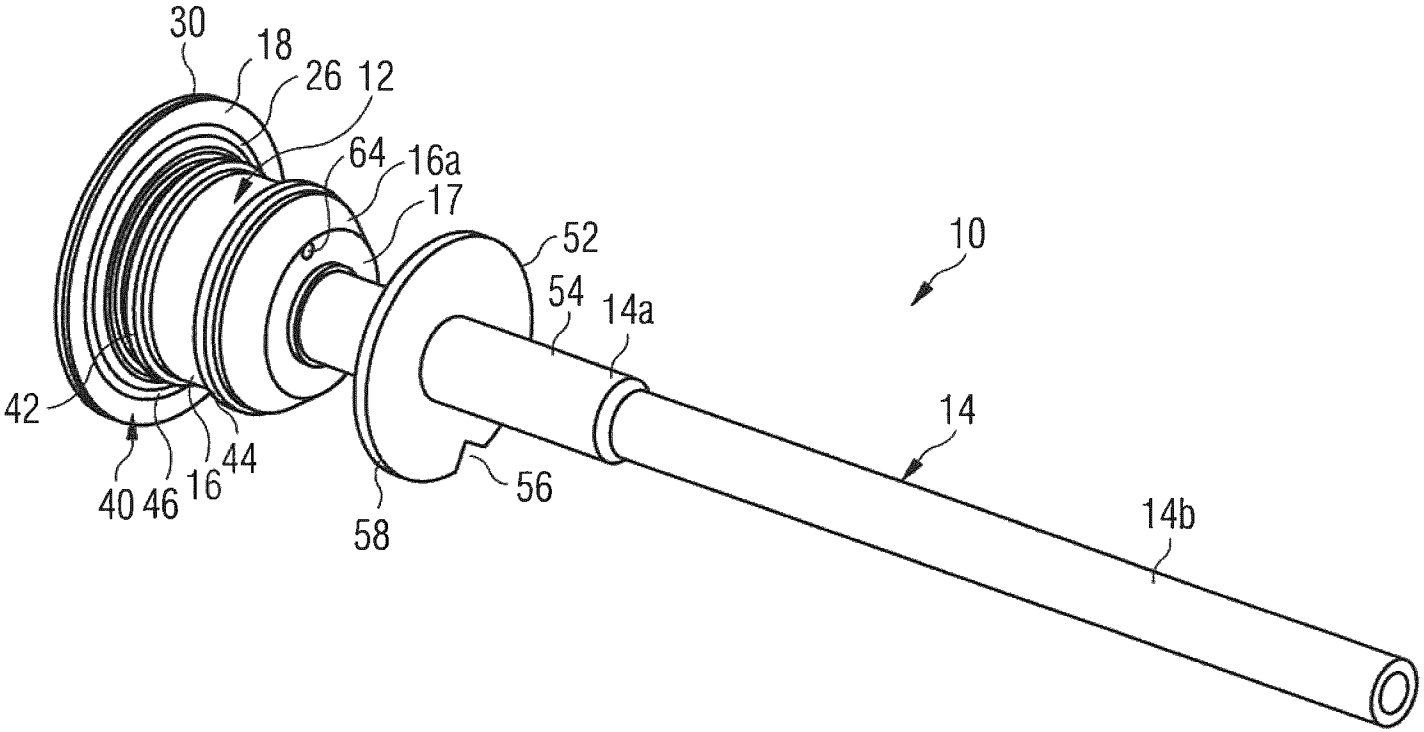

U.S. PATENT DOCUMENTS 4,156,505 A * 5/1979 Bennett ..... B05B 11/043 222/212
4,230,112 A * 10/1980 Smith ..... A61J 1/2096 141/311 R
4,327,782 A * 5/1982 McKibben ..... G01F 11/084 141/26
4,770,323 A * 9/1988 Debard ..... B05B 11/0037 222/82
5,282,552 A 2/1994 Ophardt
5,598,939 A * 2/1997 Watson ..... A61J 1/2096 215/277
5,746,349 A * 5/1998 Putteman ..... G01F 11/027 222/49
6,112,779 A * 9/2000 Camilla ..... A61J 1/2096 141/22
6,142,345 A * 11/2000 Laible ..... B67D 7/0277 222/189.1
8,171,963 B2 * 5/2012 Sonnier ..... G01F 11/027 141/27
8,434,645 B2 * 5/2013 Crawford ..... B05B 15/30 222/109
9,682,393 B2 6/2017 Erlandson et al.
10,874,188 B2 * 12/2020 Kim ..... B65B 3/04
2006/0025747 A1 2/2006 Sullivan et al.
2011/0309114 A1 12/2011 Chen
2013/0074983 A1 * 3/2013 Choi ..... B05B 11/3007 141/23
2016/0025747 A1 1/2016 Ranum et al.
2016/0145034 A1 5/2016 Laidler et al.

OTHER PUBLICATIONS

International Search Report issued by the European Patent Office for International Patent Application No. PCT/EP2018/050258 dated Mar. 16, 2018.
Written opinion issued by the European Patent Office for International Patent Application No. PCT/EP2018/050258 dated Mar. 16, 2018.
International Preliminary Report on Patentability issued by the European Patent Office for International Patent Application No. PCT/EP2018/050258 dated Jul. 23, 2019.
Office Action issued by the European Patent Office for European Patent Application No. 18 700 639.0, dated Jan. 25, 2022.

* cited by examiner

DIP TUBE

CROSS-REFERENCES TO RELATED APPLICATIONS

This application is a national stage entry, filed under 35 U.S.C. § 371, of International Application No. PCT/EP2018/050258, filed on Jan. 5, 2018, and claims the benefit of and priority to European Patent Application No. 17151958.0, filed Jan. 18, 2017, the entire contents of which are hereby incorporated herein by reference in their entireties and for all purposes.

The invention relates to a dip tube for extracting a fluid from a bottle.

Dip tubes are used in the art for extracting fluids, in particular liquids, from packaging containers. In a known administration system for medication, a bottle containing the medication is delivered with a dip tube inserted therein. The dip tube comprises a withdrawal tube extending into an interior of the bottle and a plug which is supported on an upper rim of a bottle neck. The plug is provided with an opening which extends through the plug and is in fluid communication with the withdrawal tube. For extracting the medication from the bottle, an oral dosing syringe is inserted into the opening formed in the plug and operated so as to generate a suction force which sucks the liquid medication from the bottle through the withdrawal tube and the opening extending through the plug into the syringe.

The invention is directed at the object of providing a dip tube suitable for use in an administration system which allows handling and administering a fluid, in particular a medication, in a particularly safe and reliable manner. Further, the invention is directed at the object of providing an administration system which allows administering a fluid, in particular a medication, in a particularly safe and reliable manner.

These objects are addressed by a dip tube as defined in claim 1 and an administration system as defined in claim 14.

A dip tube for extracting a fluid from a bottle comprises an adapter which is configured to be at least partially inserted into a neck of the bottle. In other words, an outer contour of the adapter has a design, i.e. the adapter has a shape and dimensions which allow at least a part of the adapter to be inserted into the bottle neck. In particular, the adapter is configured to be inserted into the bottle neck via an opening defining an upper end of the bottle neck. The bottle may be made of any suitable material in dependence on the fluid to be received therein. The fluid to be extracted from the bottle preferably contains a liquid medication, in particular a medication for oral administration.

The adapter is provided with a connecting port which is configured to be connected to a suction device. The connecting port of the adapter preferably has a size and a shape which is adjusted to a size and a shape of a tip or another connecting element of the suction device. The suction device may be syringe, in particular a syringe for oral administration of a liquid medication. The connecting port then preferably is configured to interact with a tip of the oral administration syringe. The connecting port may have a tapered inner surface, i.e. an inner diameter which decreases in the direction of a through-opening extending through the adapter and which, for example, is suitable to interact with a syringe tip having a complementary tapered outer surface. The through-opening extending through the adapter may have a constant inner diameter which is smaller than a minimum inner diameter of the connecting port. A shoulder defined in a transition region between the connecting port and the through-opening then may define an abutting surface adapted to interact with a front end face of the connecting element of the suction device upon connecting the suction device to the connecting port in order to limit an insertion depth of the connecting element of the suction device into the connecting port.

The dip tube further comprises an elongated hollow withdrawal tube which has a cross-sectional area that is smaller than a cross-sectional area of the adapter and which is configured to protrude from the adapter into a fluid receiving space of the bottle, when the adapter is inserted in the bottle neck. In the context of this application, the term "fluid receiving space" designates a part of the bottle which, upon delivery of the bottle, i.e. when the fluid filling level of the bottle is at maximum, is filled with fluid. In dependence on the usual initial filling level of the bottle upon delivery, the fluid receiving space of the bottle may be arranged below the bottle neck and may have a cross-sectional area that is larger than a cross-sectional area of the bottle neck. It is, however, also conceivable that the fluid receiving space of the bottle extends into the bottle neck or that the fluid receiving space of the bottle forms only a lower part of a bottle portion having a cross-sectional area that is larger than the cross-sectional area of the bottle neck.

The withdrawal tube preferably has a length with allows the withdrawal tube to extend below a surface of the fluid within the bottle when the adapter is received in the neck of the bottle. In order to allow the bottle to be emptied as far as possible, the length of the withdrawal tube preferably is adjusted to the dimensions of the bottle in such a manner that the withdrawal tube substantially extends to a bottom of the bottle. The withdrawal tube is arranged in fluid communication with the connecting port of the adapter. In particular, the withdrawal tube is arranged in fluid communication with the through-opening extending through the adapter which in turn is fluidly connected to the connecting port. As a result, fluid withdrawn from the bottle via the withdrawal tube may be transferred to the connecting port and further to the suction device connected to the connecting port.

The dip tube further comprises a sealing disc which extends from an outer circumferential surface of the withdrawal tube and which is configured to abut against an inner surface of the bottle so as to seal the fluid receiving space of the bottle. In other words, the sealing disc has an outer circumferential surface that is designed complementary to an inner circumferential surface of the bottle in a region of the bottle where the outer circumferential surface of the sealing disc interacts with the inner circumferential surface of the bottle. Further, the sealing disc extends from the outer surface of the withdrawal tube in such a position along the length of the withdrawal tube that the sealing disc forms a "separation wall" which substantially prevents fluid contained in the fluid receiving space from inadvertently flowing in the direction of the opening of the bottle, for example when the bottle is tumbled down.

Due to the presence of the sealing disc, a leakage of fluid from a bottle into which the dip tube is inserted becomes less likely. In particular, the risk that fluid contained in the bottle leaks or spills from the bottle in case the bottle is inadvertently tumbled down, for example upon withdrawing fluid from the bottle, is significantly reduced. As a result, the dip tube provides for an enhanced handling safety of the bottle and the fluid contained therein while simultaneously allowing withdrawing and administering the fluid from the bottle in a comfortable and reliable manner.

Preferably, the sealing disc extends from the outer surface of the withdrawal tube in such a position along the length of the withdrawal tube that the sealing disc is arranged adjacent to an upper end surface of the bottle's fluid receiving space. The sealing disc then preferably has a design, i.e. a cross-sectional shape that is adapted to a shape of the upper end surface of the bottle's fluid receiving space. It is, however, also conceivable that the sealing disc extends from the outer surface of the withdrawal tube in such a position along the length of the withdrawal tube that the sealing disc is arranged at a distance from the upper end surface of the bottle's fluid receiving space. In any case, the design, in particular the cross-sectional shape of the sealing disc should be adjusted as close as possible to the cross-sectional shape of the bottle in the region of the bottle where the inner surface of the bottle interacts with the outer circumferential surface of the sealing disc in order to separate the fluid receiving space from a remaining portion of the bottle. In a particularly preferred embodiment of the dip tube, the sealing disc extends from the outer surface of the withdrawal tube in such a position along the length of the withdrawal tube that the sealing disc sealingly abuts against the inner surface of the bottle in a transition region between the bottle neck and a bottle portion having an enlarged cross-sectional area as compared to the bottle neck.

In a preferred embodiment of the dip tube, the sealing disc extends substantially perpendicular to a longitudinal axis of the withdrawal tube. In case the dip tube is intended to be inserted into a bottle which, at least in the region of the bottle where the inner surface of the bottle interacts with the outer circumferential surface of the sealing disc, has a circular cross-sectional shape, the sealing disc preferably is designed in the form of a circular plate having an outer diameter which substantially corresponds to the inner diameter of the bottle in the region where the inner surface of the bottle interacts with an outer circumferential surface of the sealing disc. In a particularly preferred embodiment of the dip tube, the sealing disc is adapted to interact Preferably, the sealing disc is provided with a spillage prevention opening which is configured to allow a passage of fluid therethrough upon positioning the sealing disc within the bottle. Due to the presence of the spillage prevention opening, uncontrolled spillage of fluid from the bottle is prevented when the sealing disc, upon insertion of the withdrawal tube into the bottle, comes into contact with the fluid contained in the bottle's fluid receiving space. Providing the sealing disc with a spillage prevention opening is particularly advantageous in case the sealing disc extends from the outer surface of the withdrawal tube in such a position along the length of the withdrawal tube that the sealing disc, upon insertion of the withdrawal tube into the bottle, is positioned close to an upper end surface of the bottle's fluid receiving space.

Basically, the spillage prevention opening may have any desired cross-sectional shape as long as it extends through the sealing disc and allows a fluid flow therethrough which is sufficient to prevent uncontrolled spillage of the fluid when the sealing disc comes into contact with the fluid. Further, spillage prevention opening may be arranged in any desired region of the sealing disc. Preferably, however, the spillage prevention opening is designed in the form of a notch which extends from the outer circumferential surface of the sealing disc in the direction of a central portion of the sealing disc, i.e. in the direction of the withdrawal tube. The spillage prevention opening than can easily be manufactured.

The adapter of the dip tube may comprise a stopper flange configured to abut against an upper rim of the bottle neck. The stopper flange limits an insertion depth of the adapter into the bottle neck and hence ensures that the dip tube is properly positioned within the bottle. In particular, the stopper flange may be configured to allow the fastening of a bottle closure cap to the bottle with the adapter being inserted in the bottle neck. The bottle closure cap preferably is a child resistant bottle closure cap.

The preferably child resistant closure cap, in the region of an inner surface thereof, may be provided with a thread which is adapted to interact with a complementary thread provided in the region of an outer circumferential surface of the bottle neck. In order to allow the fastening of closure cap to the bottle with the adapter being inserted in the bottle neck, the stopper flange preferably is designed and dimensioned in such a manner that the stopper flange, in a direction substantially perpendicular to a central longitudinal axis of the bottle neck, does not or at least not substantially extend beyond an outer circumferential surface of the bottle neck. Furthermore, the stopper flange, in a direction along the central longitudinal axis of the bottle neck, is of a flat design, which allows an unhindered for example screw fastening of the closure cap to the bottle neck. For example, the extension of the stopper flange in the direction along the central longitudinal axis of the bottle neck may be <1 mm. As a result, the dip tube may remain attached to the bottle with the adapter being plugged in the bottle neck and the withdrawal tube extending into the bottle after first use of the bottle, i.e. after extracting the first dose of fluid from the bottle.

In a preferred embodiment of the dip tube, the dip tube comprises a first sealing device configured to sealingly abut against at least one of the upper rim of the bottle neck and an inner surface of an end face of the bottle closure cap. The first sealing device further reduces the risk that fluid contained in the bottle leaks from the bottle when the dip tube is inserted in the bottle, for example when the bottle is inadvertently tumbledown.

The first sealing device may comprise at least one of a first sealing rib and a second sealing rib. The first sealing rib may comprise a first portion which extends from a first surface of the stopper flange, i.e. a surface of the stopper flange which faces the inner surface of the end face of the bottle closure cap when the dip tube is inserted in the bottle and the closure cap is attached to the bottle neck. The first portion of the first sealing rib may be configured to sealingly abut against the inner surface of the end face of the bottle closure cap to form a seal between the first surface of the stopper flange and the inner surface of the end face of the bottle closure cap. Preferably, the first portion of the first sealing rib, in a circumferential direction, has a continuous shape. The first portion of the first sealing rib prevents fluid present in the region of the first surface of the stopper flange from leaking from the bottle, at least when the bottle closure cap is attached to the bottle neck. Further, the first portion of the first sealing rib, in a region adjacent to the first surface of the stopper flange, may have a width that is larger than a width of a tip region of the first portion which protrudes from the first surface of the stopper flange.

Further, the first sealing rib of the first sealing device may comprise a second portion which extends from a second surface of the stopper flange which is arranged opposite to the first surface of the stopper flange. When the dip tube is inserted in a bottle, the second surface of the stopper flange faces the bottle. The second portion of the first sealing rib may be configured to sealingly abut against the upper rim of the bottle neck when the dip tube is inserted in the bottle. As a result, the second portion of the first sealing rib is configured to form a seal between the second surface of the stopper flange and the upper rim of the bottle neck. At least the second portion of the first sealing rib has a shape that is adapted to shape of the upper rim of the bottle neck. For example, in case the upper rim of the bottle neck has a circular shape, the second portion of the first sealing rib has a corresponding circular shape with a corresponding diameter.

The second sealing rib of the first sealing device may extend from a surface of the adapter which faces away from the bottle when the adapter is inserted in the bottleneck and, similar to the first portion of the first sealing rib, may be configured to sealingly abut against the inner surface of the end face of the bottle closure cap. Preferably, the second sealing rib surrounds the connecting port of the dip tube adapter, i.e. an opening of the connecting port formed in the first surface of the stopper flange. As a result, the second sealing rib prevents fluid from leaking from the bottle via the through-opening and the connecting port formed in the dip tube adapter, at least when the bottle closure cap is attached to the bottle neck. Preferably, the second sealing rib and the first portion of the first sealing rib are concentrically arranged with the first portion of the first sealing rib surrounding the second sealing rib.

The dip tube adapter may also comprise a plug portion configured to be received within the bottle neck. The design of an outer contour of the plug portion preferably is selected in such a manner that the plug portion fits in the bottle neck, i.e. can be introduced into the opening of the bottle neck and received therein. For example, the adapter of a dip tube suitable for insertion into a bottle having a bottle neck with a circular cross section preferably is provided with a plug portion which also has a substantially circular cross-section, i.e. a plug portion having a substantially circular cylindrical shape. In a particularly preferred embodiment of the dip tube, the plug portion of the adapter is configured to be inserted and to fit into a PP18 mm bottle neck-finish.

Preferably, the dip tube, in particular in the region of the plug portion of the adapter, is provided with a second sealing device which is configured to sealingly abut against an inner surface of the bottle neck. In particular, the second sealing device is configured to form a press fit with the inner surface of the bottle neck. This may be achieved, for example, by designing the second sealing device with outer dimensions which slightly exceed inner dimensions of the bottle neck. The second sealing device prevents fluid contained in the bottle from leaking from the bottle via a leakage path between an outer surface of the plug portion and the inner surface of the bottle neck. Further, the press fit design of the second sealing device allows the adapter to be inserted into the bottle neck with a convenient attachment force, whereas a high detachment force is necessary for detaching the adapter from the bottle neck. Hence, the dip tube distinguishes by a high handling comfort and simultaneously a high operational safety.

The second sealing device preferably comprises at least one further sealing rib extending from an outer circumferential surface of the plug portion and being adapted to sealingly abut against the inner surface of the bottle neck. Preferably, however, the second sealing device comprises a plurality of further sealing rips, for example a third sealing rib extending from an outer circumferential surface of the plug portion and a fourth sealing rib extending from the outer circumferential surface of the plug portion at a distance from the third sealing rib. In particular, each of the third and the fourth sealing rib is designed so as to form a press fit with the inner surface of the bottle neck. This may be achieved, for example, by designing the third and the fourth sealing rib of the second sealing device with an outer diameter which slightly exceeds an inner diameter of the bottle neck.

Furthermore, the third and the fourth sealing rib may be made of a slightly compressible material such as, for example polyolefine, in particular low density polyethylene. Upon inserting the adapter into the bottle neck, the third and the fourth sealing rib then may be slightly compressed so as to finally form a press fit with the inner surface of the bottle neck when the adapter is arranged in its final position within the bottle neck. Such a design of the second sealing device ensures that the dip tube can be attached to the bottle with a convenient or at least reasonable attachment force, whereas a high detachment force is required for removing the adapter from the bottle neck. As a result, a secure fitting of the adapter to the bottle neck and hence a secure fitting of the dip tube to the bottle is ensured.

In a region arranged adjacent to the withdrawal tube, the adapter may be designed in such a manner that a cross-sectional area of the adapter decreases in a direction towards an end face of the adapter which faces the withdrawal tube. Upon attaching the dip tube to a fluid containing bottle, the region of the adapter with a decreasing cross-sectional area, i.e. the region of the adapter plug portion with a decreasing cross-sectional area can easily be inserted into the bottle neck. Further, due to the interaction of the adapter region with a decreasing cross-sectional area with the bottle neck, the adapter of the dip tube is guided into the desired position relative to the bottle neck until the adapter, i.e. in particular the plug portion of the adapter is sealingly received within the bottle neck. As a result, insertion of the adapter into the bottle neck and hence the handling of the dip tube is simplified. In an adapter wherein the plug portion has a substantially circular cross-section and a substantially circular cylindrical shape, the adapter region with a decreasing cross-sectional area may have a frustro conical shape.

Upon extracting a fluid from a bottle via a dip tube by means of a suction device, a fluid containing a liquid, for example a liquid medication received in the bottle, and gas bubbles, in particular air bubbles, may be sucked into a container of the suction device. The presence of large gas bubbles in the fluid, however, would affect the dosage accuracy upon administrating the liquid medication to a patient. Therefore, in conventional medication administration systems, the bottle containing the liquid medication, after being connected to a suction device, for example a syringe, is turned upside down in order to bring the suction device in direct contact with the liquid and hence ensure that the liquid can be sucked into the container the suction device substantially free of gas bubbles.

In a preferred embodiment of the dip tube, the adapter is provided with a vent hole which is configured to establish a venting path between the fluid receiving space of the bottle and an ambient atmosphere. For example, the vent hole may extend through the adapter in a direction substantially parallel to a longitudinal axis of the adapter. Due to the presence of a vent hole in the adapter of the dip tube, gas bubbles, in particular air bubbles, contained in a fluid sucked from the bottle into a container of a suction device may be removed from the fluid by simply discharging the fluid back into the bottle and sucking it into the container of the suction device again without any overpressure risk inside the bottle, since the gas bubbles are vented from the interior of the bottle via the vent hole upon discharging the fluid from the container of the suction device back onto the bottle. As a result, the dip tube allows extracting a fluid which is substantially free from at least large gas bubbles from a bottle without turning the bottle upside down. This further reduces the risk of fluid leakage or spillage and, in addition, increases the handling comfort and the dosage accuracy of an administration system comprising the dip tube described herein.

In a particularly preferred embodiment of the dip tube, a spillage channel is formed in the adapter. The spillage channel may have an access opening formed in a surface of the adapter which faces away from the bottle when the adapter is inserted in the bottle neck. The spillage channel serves to collect fluid which inadvertently is received on the adapter surface which faces away from the bottle when the adapter is inserted in the bottleneck, for example upon disconnecting a suction device from the connection port of the adapter. In a preferred embodiment, the spillage channel extends substantially parallel to the longitudinal axis of the adapter along at least 50%, preferably at least 80% of the length of the adapter along its longitudinal axis. Due to the presence of the spillage channel, the fluid leakage risk is further reduced.

The spillage channel may extend around the connecting port of the adapter. In particular, the spillage channel may extend concentrically around the connecting port of the adapter which may be arranged in a central region of the adapter. Further, the spillage channel preferably has a ring-shaped cross-section.

A dip tube which comprises an adapter provided with a spillage channel may be claimed independently from the above described dip tube design. In particular, an independent claim may be formulated which is directed to a dip tube for extracting a fluid from a bottle which comprises an adapter configured to be inserted into a neck of the bottle and being provided with a connecting port which is configured to be connected to a suction device, and an elongated hollow withdrawal tube which is configured to protrude from the adapter into a fluid receiving space of the bottle, when the adapter is inserted in the bottle neck, and which is arranged in fluid communication with the connecting port of the adapter, wherein a spillage channel is formed in the adapter. The spillage channel may be designed as described above.

The vent hole formed in the adapter may extend from an end face of the adapter which faces the withdrawal tube to a bottom surface of the spillage channel. As a result, the vent hole may fulfill the double function of, at the one hand, allowing a pressure equalization between the interior of the bottle and the ambient atmosphere, for example upon discharging fluid sucked from the bottle into a container of a suction device back into the bottle, and, on the other hand, allowing fluid which is received and collected in the spillage channel to flow back into the fluid receiving space of the bottle.

The withdrawal tube of the dip tube may comprise a first portion which faces the adapter and a second portion which faces away from the adapter. An outer dimension, in particular an outer diameter of the first portion may be larger than an outer dimension, in particular an outer diameter of the second portion. Additionally or alternatively thereto, a wall thickness of the first portion may be larger than a wall thickness of the second portion. As a result, the second portion may deformable, at least to a certain extent, upon abutting against an inner surface of a bottom of the bottle. Such a design of the withdrawal tube allows the bottle to be emptied as far as possible. Simultaneously, the first portion of the withdrawal tube provides for the desired stability and structural integrity of the withdrawal tube, in particular upon inserting the dip tube into the bottle.

Preferably, the dip tube is designed in the form of a one-piece component. The dip tube then is easy to handle. Further, a one-piece dip tube does not contain components that are small enough that they can inadvertently be swallowed, for example by a pediatric or a senior patient to be treated with the fluid withdrawn from a bottle with the aid of the dip tube.

Further, the dip tube preferably is made of polyolefine, in particular low density polyethylene. The dip tube then may be made without plasticizers and is suitable for use for extracting oral liquid drug products from a medication bottle.

An administration system comprises a bottle having a fluid receiving space and a bottle neck. The bottle may be made of any suitable material in dependence on the fluid to be received therein. For example, the bottle may be made of glass or a suitable plastic material. In a particularly preferred embodiment of the administration system, the bottle is a 30 ml amber glass bottle, a 5 ml amber glass bottle or a 20 ml amber glass bottle which is provided with a PP18 mm bottle neck-finish. Further, the administration system comprises a dip tube as described above. The dip tube is in particular configured to be inserted into the bottle in order to extract a fluid, in particular a medication, from the bottle.

The administration system may further comprise a suction device having a connecting end adapted to be connected to the connecting port of the dip tube adapter. The suction device may further comprise a container in fluid communication with the connecting end for receiving the fluid which is extracted from the bottle with the aid of the dip tube. In a preferred embodiment of the administration system, the suction device is designed in the form of an oral administration syringe having a connecting end in the form of a tip adapted to be inserted into the connecting port of the dip tube. The tip of the oral administration syringe preferably has a tapered outer surface, i.e. an outer diameter of the syringe tube preferably decreases in a direction of a distal end of the syringe tip.

Figure 2:
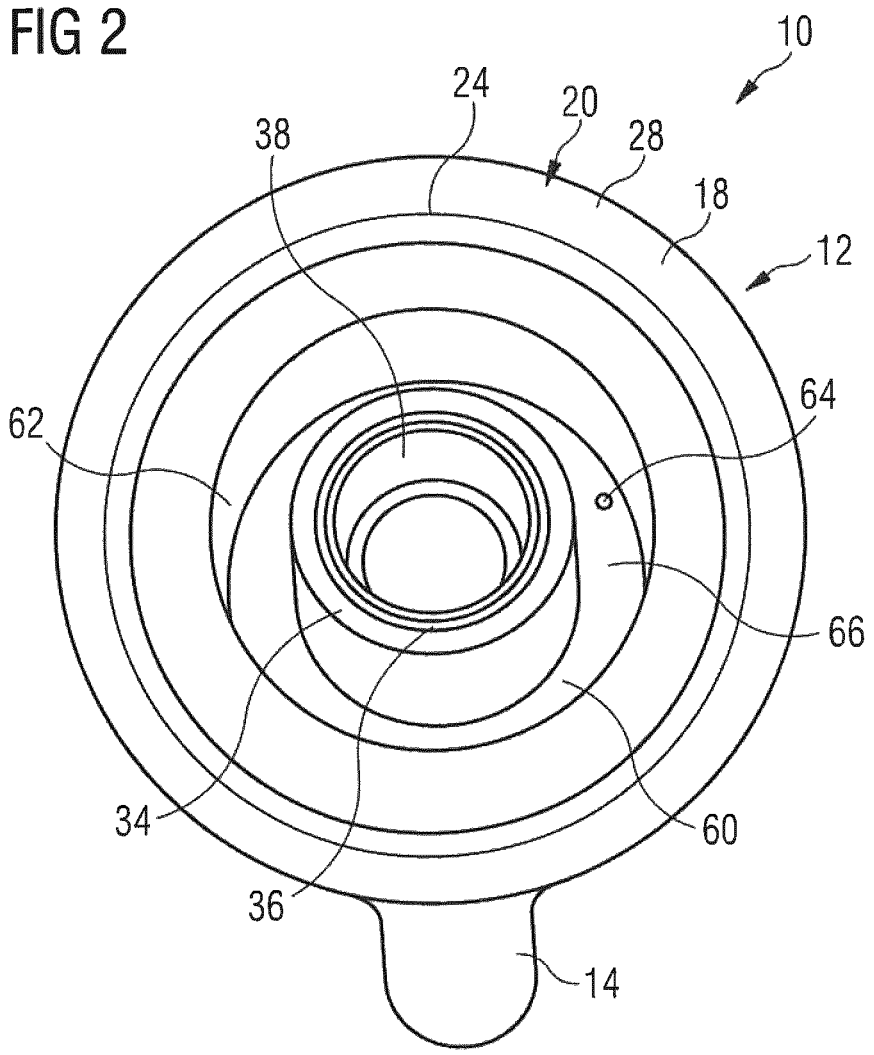
Figure 3:
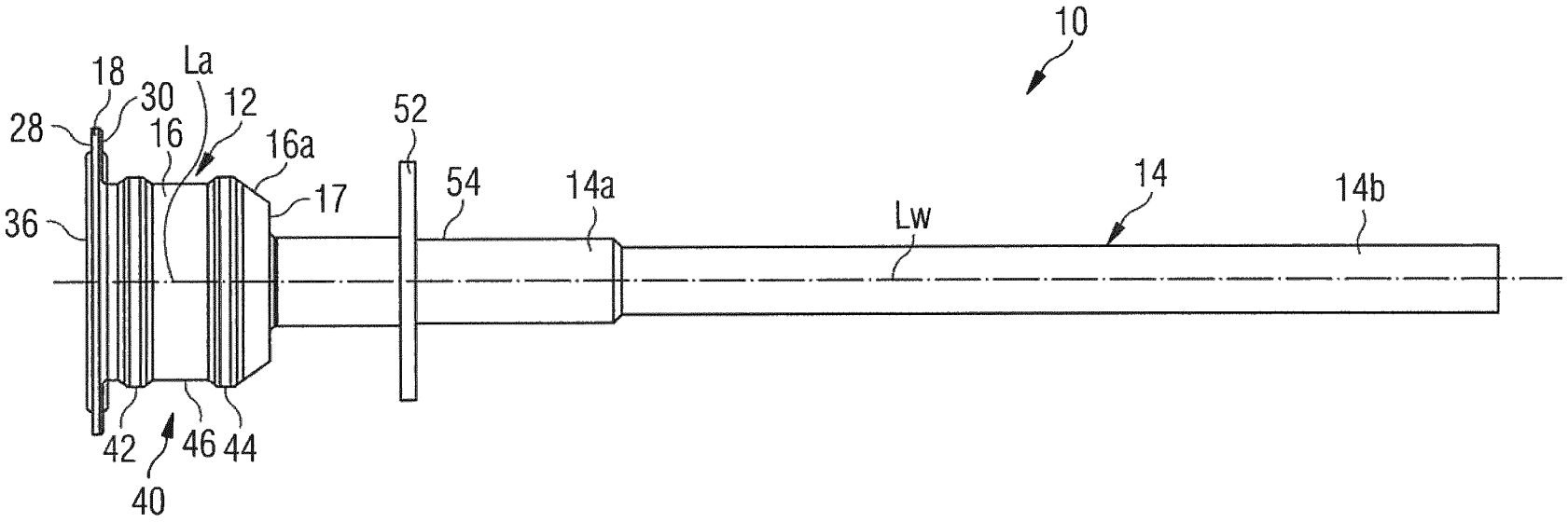
Figure 4:
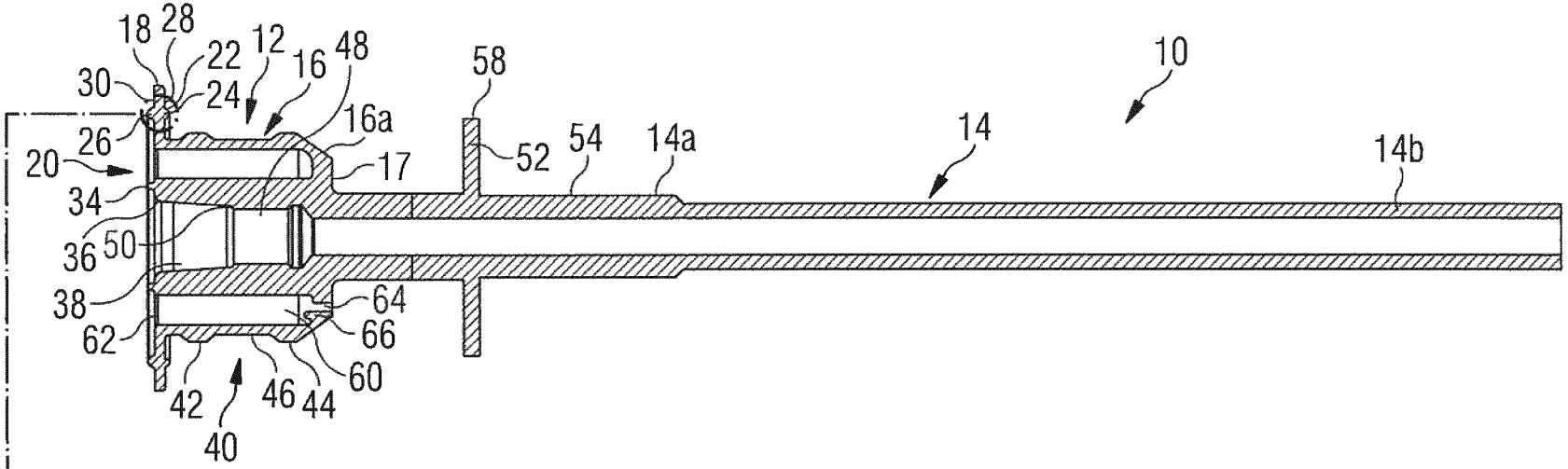
Figure 5:
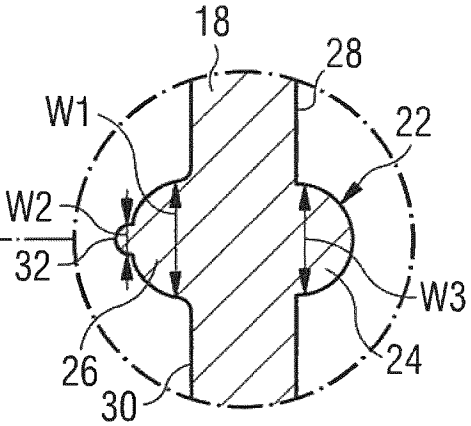
Figure 6:
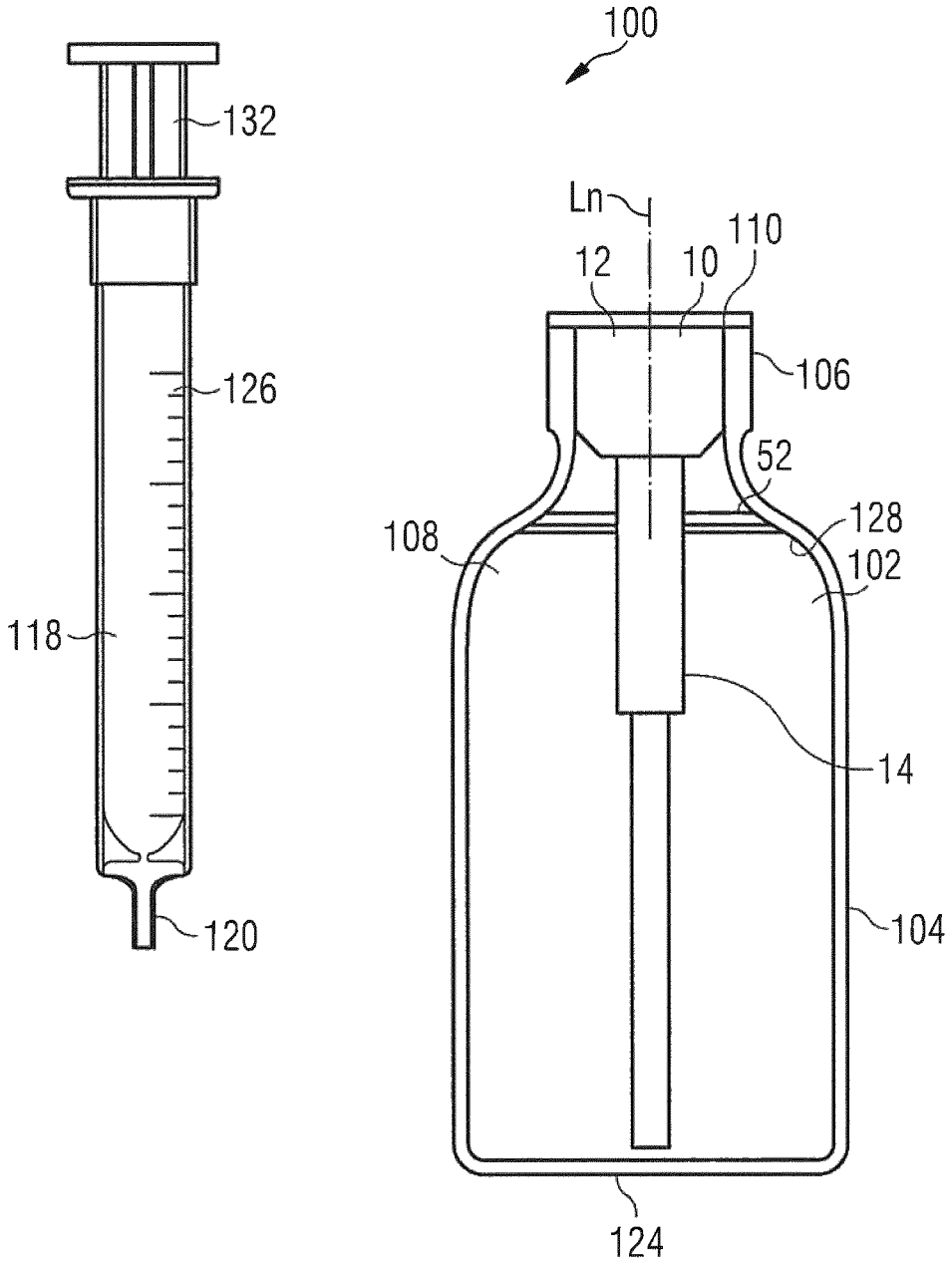
Figure 7:
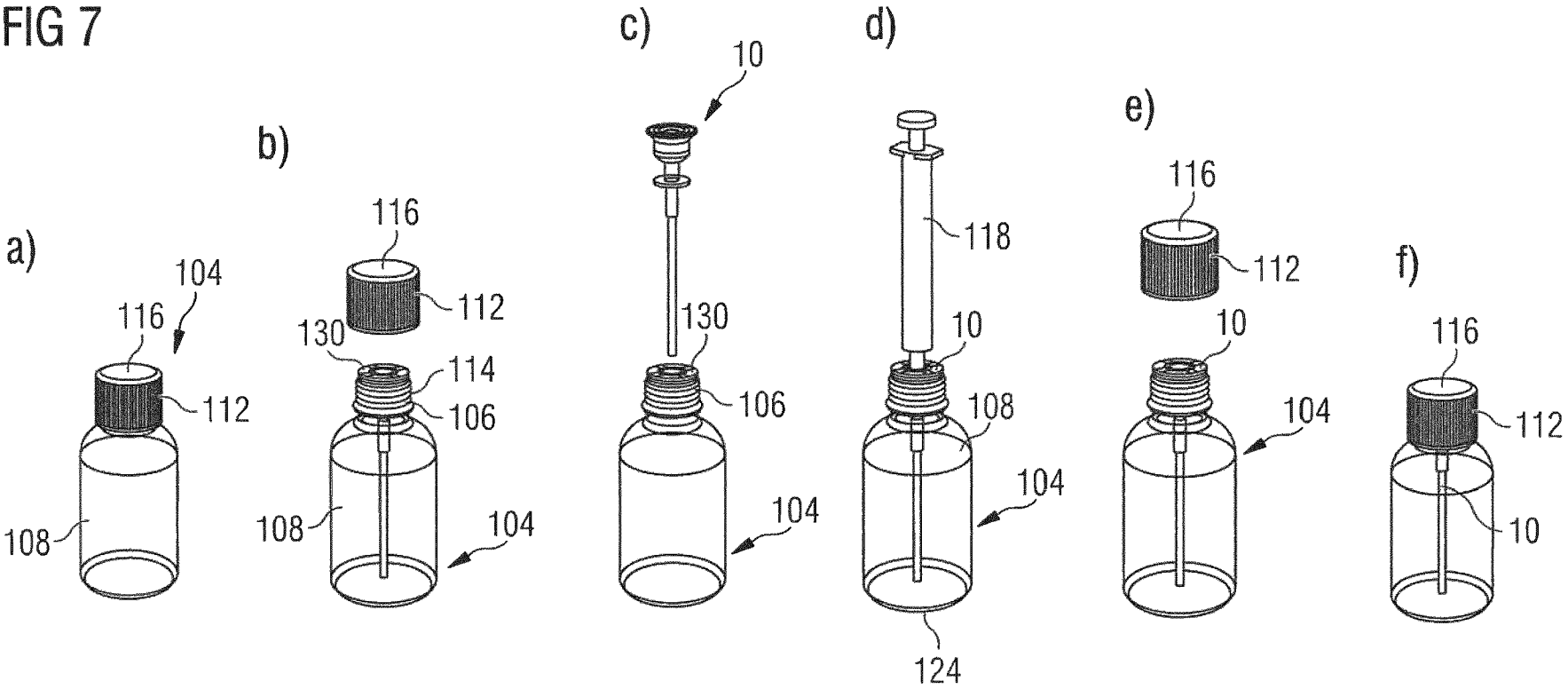

A preferred embodiment of the invention now will be described in greater detail with reference to the appended schematic drawings, wherein:

FIG. 1 shows a three-dimensional view of a dip tube for extracting a fluid from a bottle, FIG. 2 shows a three-dimensional top view of the dip tube according to FIG. 1, FIG. 3 shows a side view of the dip tube according to FIG. 1, FIG. 4 shows a longitudinal sectional view of the dip tube according to FIG. 1, FIG. 5 shows a detailed view of a first sealing rib of the first sealing device of the dip tube depicted in FIG. 4, FIG. 6 shows an administration system comprising the dip tube according to FIGS. 1 to 6, and FIGS. 7*a-f* illustrate the use of the administration system according to FIG. 7.

FIGS. 1 to 6 illustrate a dip tube 10 for use in an administration system 100 as shown in FIGS. 6 and 7 for extracting a fluid 102 from a bottle 104. The dip tube 10 comprises an adapter 12 and an elongated hollow withdrawal tube 14. The withdrawal tube 14 has a cross-sectional area that is smaller than a cross-sectional area of the adapter 12. The dip tube 10 is designed in the form of a one-piece component and made of low density polyethylene. As becomes apparent from FIGS. 6 and 7, in use in the administration system 100, the dip tube 10 is inserted into the bottle 104 in such a manner that a part of the adapter 12 is inserted into a neck 106 of the bottle 104 and the withdrawal tube 14 protrudes from the adapter 12 into a fluid receiving space 108 of the bottle 104.

As shown in FIGS. 1, 3 and 4, the adapter 12 comprises a plug portion 16 which is configured to be received within the bottle neck 106. In order to allow the plug portion 16 of the adapter 12 to be inserted into the bottle neck 106, an outer contour of the plug portion 16 is adapted to an inner contour of the bottle neck 106. In the embodiment of the dip tube 10 shown in the drawings, the dip tube 10 is designed for insertion into a bottle 104 having a bottle neck 106 with a circular cross-section. Therefore, the plug portion 16 of the adapter 12 also has a substantially circular cross-section. In particular, the plug portion 16 of the adapter 12 is configured to be inserted and fit into a PP18 mm bottle neck-finish.

In a region 16*a* adjacent to the withdrawal tube 14, the adapter 12, i.e. the plug portion 16 of the adapter 12, is designed in such a manner that a cross-sectional area of the adapter 12 decreases in a direction towards an end face 17 of the adapter 12 which faces the withdrawal tube 14. In the embodiment of the dip tube 10 shown in the drawings, wherein the plug portion 16 of the adapter 12 has a substantially circular cross-section and a substantially circular cylindrical shape, the adapter region 16*a* with a decreasing cross-sectional area has a substantially frustro conical shape.

The adapter 12 further comprises a stopper flange 18 which, in the embodiment of the dip tube 10 as shown in the drawings, radially protrudes from the plug portion 16 of the adapter 12 in the region of a proximal end thereof. When the dip tube 10 is inserted in the bottle 104, the stopper flange 18 of the adapter 12 abuts against an upper rim 110 of the bottle neck 106 and hence limits an insertion depth of the adapter 12 into the bottle neck 106. The design of the stopper flange 18 is adapted to the design of the bottle neck 106, i.e. the stopper flange 18 is of a ring-shaped design, wherein an outer diameter of the stopper flange 18 is selected in such a manner that the stopper flange 18 is securely supported by the upper rim 110 of the bottle neck 106, but does not or at least not substantially extend beyond an outer circumferential surface of the bottle neck 106. Further, an extension of the stopper flange 18 in a direction along a central longitudinal axis Ln of the bottle neck 106 is <1 mm.

This design of the stopper flange 18 allows the fastening of a bottle closure cap 112 to the bottle 104 with the adapter 12 being inserted in the bottle neck 106. Hence, the dip tube 10 may remain inserted in the bottle 104 after the first use of the bottle 104, i.e. after extracting a first dose of fluid 102 from the bottle 104 with the aid of the dip tube 10, see in particular FIGS. 7*e-f*. In the embodiment of a bottle 104 shown in the drawings, the bottle closure cap 112 is designed in the form of a child resistant bottle closure cap. In the region of its inner surface, the bottle closure cap 112 is provided with a thread that is adapted to interact with a complementary thread 114 provided in the region of an outer circumferential surface of the bottle neck 106.

As shown in particular in FIGS. 4 and 5, the dip tube 10 comprises a first sealing device 20 which is configured to sealingly abut against the upper rim 110 of the bottle neck 106 and, when the closure cap 112 is screw fastened to the bottle neck 106 with the dip tube 10 being inserted in the bottle 104 as illustrated in FIG. 7*f*, to also sealingly abut against an inner surface of an end face 116 of the bottle closure cap 112. The first sealing device 20 comprises a ring-shaped first sealing rib 22 that has a first portion 24 and a second portion 26, see in particular FIG. 5.

The first portion 24 of the first sealing rib 22 extends from a first surface 28 of the stopper flange 18 which faces the inner surface of the end face 116 of the bottle closure cap 112, when the dip tube 10 is inserted in the bottle 104 and the closure cap 112 is screw fastened to the bottle neck 106 as illustrated in FIG. 7*f*. In a region adjacent to the first surface 28 of the stopper flange 18, the first portion 24 of the first sealing rib 22 has a width w1 that is larger than a width w2 of a tip region 32 of the first portion 24 of the first sealing rib 22. When the dip tube 10 is inserted in the bottle 104 and the closure cap 112 is screw fastened to the bottle neck 106, the first portion 24 of the first sealing rib 22 sealingly abuts against the inner surface of the end face 116 of the bottle closure cap 112 and hence forms a seal between the first surface 28 of the stopper flange 18 and the inner surface of the end face 116 of the bottle closure cap 112.

The second portion 26 of the first sealing rib 22 extends from a second surface 30 of the stopper flange 18 which is arranged opposite to the first surface 28 and which faces the upper rim 110 of the bottle neck 106, when the dip tube 10 is inserted in the bottle 104. A width w3 of the second portion 26 of the first sealing rib 22 is smaller than the width w1 of the first portion 24 of the first sealing rib 22 in a region adjacent to the first surface 28 of the stopper flange 18 and smaller than a width of the upper rim 110 of the bottleneck 106, but larger than the width w2 of the first portion 24 of the first sealing rib 22 in its tip region 32. When the dip tube 10 is inserted in the bottle 104, the second portion 26 of the first sealing rib 22 sealingly abuts against the upper rim 110 of the bottle neck 106 and hence forms a seal between the second surface 30 of the stopper flange 18 and the upper rim 110 of the bottle neck 106.

In the embodiment of the dip tube 10 shown in the drawings the first sealing device 20 comprises only one first rib 22 with a first and the second portion 24, 26. It is, however, also conceivable that the first sealing device 20 comprises a plurality, in particular two first ribs 22, one extending from the first surface 28 of the stopper flange 18 and one extending from the second surface 30 of the stopper flange 18. The two first ribs 22 may be arranged offset relative to each other and may also have different shapes in dependence on the design of the bottle neck 106 and the design of the bottle closure cap 112.

The first sealing device 22 further comprises a second sealing rib 34 that extends from a surface 36 of the adapter 12 which faces away from the bottle 104 when the adapter 12 is inserted in the bottle neck 106 and hence extends coplanar with the first surface 28 of the stopper flange 18. Like the first sealing rib 22, the second sealing rib 34 is also of a ring-shaped design, extends concentrically with the first portion 24 of the first sealing rib 22 and surrounds a connecting port 38 which is formed in the adapter 12 and which will be described in greater detail below. When the dip tube 10 is inserted in the bottle 104 and the closure cap 112 is screw fastened to the bottle neck 106 as illustrated in FIG. 7*f*, the second sealing rib 34 of the first sealing device 20 sealingly abuts against the inner surface of the end face 116 of the bottle closure cap 112 and hence forms a seal between the surface 36 of the adapter 12 and the inner surface of the end face 116 of the bottle closure cap 112.

The dip tube 10 further comprises a second sealing device 40 which is configured to sealingly abut against an inner surface of the bottle neck 106 and in particular to form a press fit with the inner surface of the bottle neck 106, when the adapter 12 is inserted in the bottle neck 106. The second sealing rib comprises a third and a fourth sealing rib 42, 44. The ring-shaped third sealing rib 42 extends from an outer circumferential surface 46 of the plug portion 16 of the adapter 12 and is provided with a flattened tip in order to enlarge the contact area with the inner surface of the bottle neck 106. The fourth sealing rib 44 is also ring-shaped and provided with a flattened tip and extends from the outer circumferential surface 46 of the plug portion 16 of the adapter 12 at a distance from the third sealing rib 42. The third and the fourth sealing rib 42, 44 have an outer diameter which slightly exceeds an inner diameter of the bottle neck 106. Further, since the dip tube 10 and hence also the third and the fourth sealing rib 42, 44 are made from low-density polyurethane, the third and the fourth sealing rib 42, 44 are slightly compressible.

The connecting port 38 which is formed in the adapter 12 is configured to be connected to a suction device 118 which, in the embodiment of an administration system 100 shown in the drawings, is designed in the form of an oral administration syringe. The connecting port 38 therefore has a design that is adapted to a design of a connecting element, i.e. a tip 120 of the suction device 118 which is intended to be inserted into the connecting port 38. In particular, the connecting port 38 has a tapered inner surface, i.e. an inner diameter of the connecting port 38 decreases in a direction of the through-opening 48 extending through the adapter 12. The connecting port 38 thus is suitable to firmly receive the section device tip 120 which is provided with a complementary tapered outer surface. The through-opening 48 has a constant inner diameter which is smaller than a minimum inner diameter of the connecting port 38. Thus, a shoulder 50 formed in a transition region between the connecting port 38 and the through-opening 48 defines an abutting surface for interacting with a front end face of the suction device tip 120 in order to limit an insertion depth of the suction device tip 120 into the connecting port 38.

As becomes apparent in particular from FIGS. 6 and 7*d-f*, the withdrawal tube 14 has a length which allows the withdrawal tube 14 to protrude from the adapter 14 into the fluid receiving space 108 of the bottle 104, when the dip tube 10 is inserted in the bottle 14 and the adapter 12 is arranged in its final position in the bottle neck 106. The fluid receiving space 108 of the bottle 104 is defined by the maximum fluid filling level of the bottle 104 upon delivery. Further, the withdrawal tube 14 has a proximal first portion 14*a* which faces the adapter 12 and a distal second portion 14*b* which faces away from the adapter 12. An outer dimension, i.e. an outer diameter, of the first portion 14*a* is larger than an outer dimension, i.e. an outer diameter, of the second portion 14*b*. In addition, the first portion 14*a* has a wall thickness that is larger than a wall thickness of the second portion 14*b*.

The withdrawal tube 14, i.e. an inner lumen of the hollow withdrawal tube 14, is arranged in fluid communication with the connecting port 38 of the adapter 12 via the through-opening 48. Hence, fluid withdrawn from the bottle 104 via the withdrawal tube 14 can be transferred to the connecting port 38 and further to a container 126 of the suction device 118 the tip 120 of which is connected to the connecting port 38.

The dip tube 10 further comprises a sealing disc 52 which extends substantially perpendicular to a longitudinal axis Lw of the withdrawal tube 14 from an outer circumferential surface 54 of the withdrawal tube 14. The sealing disc 52 which, in the embodiment of a dip tube 10 shown in the drawings, is designed in the form of circular plate, is configured to abut against an inner surface 128 of the bottle 104 so as to seal the fluid receiving space 108 of the bottle 104, see in particular FIG. 6. In the embodiment of a dip tube 10 shown in the drawings, the sealing disc 52 extends from the outer surface 54 of the withdrawal tube 14 in such a position along the length of the withdrawal tube 14 that the sealing disc 52 is arranged slightly above an upper end surface of the fluid receiving space 108 of the bottle 104 in a transition region between the bottle neck 106 and a bottle portion having an enlarged cross-sectional area as compared to the bottle neck 106. When the dip tube 10 is inserted in the bottle 104, the sealing disc 52 thus forms a physical "separation wall" which substantially separates the fluid receiving space 108 from a remaining part of the bottle 104.

The sealing disc 52 is provided with a spillage prevention opening 56 which is configured to allow a passage of fluid 102 therethrough upon inserting the dip tube 10 into the bottle 104 and hence positioning the sealing disc 52 within the bottle 104. In the embodiment of a dip tube 10 as depicted in the drawings, the spillage prevention opening 56 is designed in the form of a notch extending radially inwards from an outer circumferential surface 58 of the sealing disc 52 in the direction of a central portion of the sealing disc 52.

The adapter 12 of the tube 10 is provided with a spillage channel 60. The spillage channel 60 has an access opening 62 formed in the surface 36 of the adapter 12 which faces away from the bottle 104 when the adapter 12 is inserted in the bottle neck 106 and serves to collect fluid 102 which is inadvertently received on the adapter surface 36, for example upon disconnecting the tip 120 of the suction device 118 from the connecting port 38 of the adapter 12. In the embodiment of the dip tube 10 shown in the drawings, the spillage channel 60 has a ring-shaped cross-section and concentrically extends around the connecting port 38. Further, the spillage channel 60, in a direction substantially parallel to a longitudinal axis La of the adapter 12, extends along more than 80% of the length of the adapter 12.

Finally, the adapter 12 of the dip tube 10 is provided with a vent hole 64 which establishes a venting path between the fluid receiving space 108 of the bottle 104 and an ambient atmosphere when the dip tube is inserted in the bottle 104. In particular, the vent hole 64 extends from the end face 17 of the adapter 12 which faces the withdrawal tube 14 to a bottom surface 66 of the spillage channel 60.

The administration system 100 according to FIG. 6 comprises the dip tube 10, the bottle 104 and the suction device 118. In the embodiment of an administration system 100 shown herein, the bottle 104 is a 30 ml amber glass bottle, a 5 ml amber glass bottle or a 20 ml amber glass bottle provided with a PP18 mm bottle neck-finish. The fluid 102 received within the bottle 104 contains a liquid medication for oral administration.

The use of the administration system 100 is depicted in greater detail in FIGS. 7*a-f*. The bottle 104 with the fluid 102 in the form of a liquid medication for oral administration contained therein, the dip tube 10 and the suction device 118 are delivered as separate components. In a first step, the child resistant closure cap 116 is unscrewed from the bottle neck 106, see FIGS. 7*a-b*. Thereafter, the dip tube 10 is inserted into the bottle 104 until the adapter 12 of the dip tube 10 is firmly received within the bottle neck 106 and the second surface 28 of the stopper flange 18 abuts against the upper rim 110 of the bottle neck 106.

Upon attaching the dip tube 10 to the bottle 104, the frustro conical region 16*a* of the adapter plug portion 16 simplifies the insertion of the adapter 12 into the bottle neck 106. Further, due to the interaction of the frustro conical region 16*a* of the adapter plug portion 16 with the inner surface of the bottle neck 106, the adapter 12 is guided into the desired position relative to the bottle neck 106 until the adapter has reached its final position within the bottleneck 106. Further, upon inserting the adapter 12 into the bottle neck 106, the third and the fourth sealing rib 42, 44 of the second sealing device 40 are slightly compressed so as to finally form a press fit with the inner surface of the bottle neck 106. Hence, the adapter 12 can be inserted into the bottle neck 106 with a convenient insertion force, whereas, however, a high detachment force would be required for detaching the adapter 12 from the bottle neck 106.

Upon inserting the dip tube 10 into the bottle 104 the sealing disc 52 which radially extends from the outer surface 54 is positioned within the bottle 104 slightly above the upper end surface of the fluid receiving space 108 of the bottle 104 in the transition region between the bottle neck 106 and the bottle portion having an enlarged cross-sectional area as compared to the bottle neck 106. Fluid 102 that comes into contact with the sealing disc 52 upon positioning the sealing disc 52 within the bottle 104 may first pass through the spillage prevention opening 56 and later flow back into the fluid receiving space 108 of the bottle 104 when the sealing disc 52 has reached its final position within the bottle 104. As a result, spillage and hence leakage of fluid 102 upon positioning the sealing disc 52 within the bottle 104 is prevented.

In order to allow the bottle 104 to be emptied as far as possible, the length of the withdrawal tube 14 is adjusted to the dimensions of the bottle 104 such that the withdrawal tube substantially extends to a bottom 124 of the bottle 104. Further, due to the design of the withdrawal tube 14 with a large diameter/large wall thickness proximal first portion 14*a* and a small diameter/small wall thickness distal second portion 14*b*, the distal second portion 14*b* of the withdrawal tube 14 is deformable to a certain extent upon abutting against an inner surface of the bottom 124 of the bottle 104, while the first portion 14*a* of the withdrawal tube 14 provides for the desired stability and structural integrity of the withdrawal to 14, in particular upon inserting the dip tube 10 into the bottle 104.

In order to extract a dose of the medication fluid 102 from the bottle 104, the suction device 118 is connected to the dip tube 10 by bringing the tip 120 of the suction device 118 into engagement with the connecting port 38 formed in the adapter 12. Thereafter, fluid 102 can be sucked into the container 126 of the suction device 118 by actuating a plunger 132 of the suction device 118, while the bottle 104 remains in its upright position. The fluid 102 which is sucked into the container 126 with the first suction stroke, however, may contain gas bubbles, i.e. air bubbles that would affect the dosage accuracy for the liquid medication. If need be, the fluid 102 therefore may be discharged back into the bottle 104 and sucked into the container 126 again several times until the fluid 102 is substantially free from at least large air bubbles. Air introduced into the bottle 104 in the course of this repeated discharge of fluid 102 back into the bottle 104 and sucking of fluid 102 from the bottle 104 into the container 126 may vent from the interior of the bottle 104 via the vent hole 64. Hence, overpressurization of the bottle 104 and spillage of fluid 102 from the bottle 104 can be prevented.

After extracting a dose of the medication fluid 102 from the bottle 104 by means of the suction device 118, the suction device 118 is detached from the connecting port 38 of the dip tube adapter 12 and the bottle closure cap 112 is again fastened to the bottle neck 106, while the dip tube 10 remains inserted in the bottle, see FIG. 8*e*. The design of the adapter 12 and in particular the design of the stopper flange 18 ensures that the screw fastening of the bottle closure cap 112 to the bottle neck 106 is not affected by the presence of the adapter 12. Fluid 102 which may, in the course of detaching the suction device 118 from the adapter 12, inadvertently be applied to the first surface 22 of the stopper flange 18 is collected in the spillage channel 60 and, via the vent hole 64, discharged back into the interior of the bottle 104.

The sealing disc 52 which forms a physical "separation wall" extending between the fluid receiving space 108 and an opening 130 of the bottle 104, prevents fluid contained in the fluid receiving space 108 from inadvertently flowing in the direction of the opening 130 of the bottle 104, for example when the bottle 104 is tumbled down. Further, due to the presence of the second sealing device 40, fluid is prevented from leaking from the system 100 via a leakage path between the outer surface 46 of the plug portion 16 and the inner surface of the bottle neck 106.

In addition, when the bottle closure cap 112 is properly secured to the bottle neck 106, the bottle closure cap 112 applies a slight pressing force to the adapter 12 of the dip tube 10. As a result, the second portion 26 of the first sealing rib 22 is pressed against the upper rim 110 of bottle neck 106 so as to form a seal. This sealing interaction of the second portion 26 of the first sealing rib 22 with the upper rim 110 of the bottle neck 106 further improves the leakage proofness of the administration system 100, since it prevents any residual fluid droplets which may be present in the region of the upper rim 110 of the bottle neck 106 from leaking from the system 100.

Moreover, the inner surface of the end face 116 of the bottle closure cap 112 sealingly interacts with both the first portion 24 of the first sealing rib 22 and the second sealing rib 34 of the first sealing device 20. While the second sealing rib 34 prevents fluid 102 from leaking from the bottle 104 via the connecting port 38 of the adapter 12, the first portion 24 of the first sealing rib 22 prevents fluid which is collected in the spillage channel 60 but still not discharged back into the interior of the bottle 104 via the vent hole 64, from leaking from the system 100. As a result, leakage proofness of the administration system 100 is insured even in case the bottle 104 with the dip tube 10 inserted therein is inadvertently tumbled down.

The invention claimed is:

1. A dip tube for extracting a fluid from a bottle, the dip tube comprising:

an adapter configured to be at least partially inserted into a bottle neck of the bottle and being provided with a connecting port which is configured to be connected to a suction device, an elongated hollow withdrawal tube which has a cross-sectional area that is smaller than a cross-sectional area of the adapter and which is configured to protrude from the adapter into a fluid receiving space of the bottle, when the adapter is inserted in the bottle neck, and which is arranged in fluid communication with the connecting port of the adapter, and a sealing disc extending from an outer circumferential surface of the elongated hollow withdrawal tube and being configured to abut against an inner surface of the bottle so as to seal the fluid receiving space of the bottle, wherein the sealing disc is provided with a spillage prevention opening configured to allow a passage of fluid therethrough upon positioning the sealing disc within the bottle.

2. The dip tube according to claim 1, wherein the sealing disc extends substantially perpendicular to a longitudinal axis of the elongated hollow withdrawal tube.

3. The dip tube according to claim 1, wherein the spillage prevention opening is designed in the form of a notch extending from an outer circumferential surface of the sealing disc in the direction of a central portion of the sealing disc.

4. The dip tube according to claim 1, wherein the adapter comprises a stopper flange configured to abut against an upper rim of the bottle neck, wherein the stopper flange in particular is configured to allow the fastening of a preferably child resistant bottle closure cap to the bottle with the adapter being inserted in the bottle neck.

5. The dip tube according to claim 4, wherein the dip tube comprises a first sealing device configured to sealingly abut against at least one of the upper rim of the bottle neck and an inner surface of an end face of the bottle closure cap, wherein the first sealing device in particular comprises at least one of:

a first sealing rib having:

a first portion extending from a first surface of the stopper flange and being configured to sealingly abut against the inner surface of the end face of the bottle closure cap, and a second portion extending from a second surface of the stopper flange and being configured to sealingly abut against the upper rim of the bottle neck, and a second sealing rib extending from a surface of the adapter which faces away from the bottle when the adapter is inserted in the bottle neck and being configured to sealingly abut against the inner surface of the end face of the bottle closure cap, the second sealing rib in particular extending concentrically with the first portion of the first sealing rib.

6. The dip tube according to claim 5, wherein the adapter comprises a plug portion configured to be received within the bottle neck, and wherein the dip tube preferably is provided with a second sealing device configured to sealingly abut against an inner surface of the bottle neck, wherein the second sealing device comprises:

a third sealing rib extending from an outer circumferential surface of the plug portion, and a fourth sealing rib extending from the outer circumferential surface of the plug portion at a distance from the third sealing rib.

7. The dip tube according to claim 1, wherein the adapter, in a region arranged adjacent to the elongated hollow withdrawal tube, is designed in such a manner that a cross-sectional area of the adapter decreases in a direction towards an end face of the adapter which faces the elongated hollow withdrawal tube.

8. The dip tube according to claim 1, wherein the elongated hollow withdrawal tube comprises a first portion which faces the adapter and a second portion which faces away from the adapter, an outer dimension of the first portion being larger than an outer dimension of the second portion and/or a wall thickness of the first portion being larger than a wall thickness of the second portion.

9. The dip tube according to claim 1, wherein the dip tube is designed in the form of a one-piece component and/or wherein the dip tube is made of polyolefine, in particular low density polyethylene.

10. An administration system, comprising:

a bottle having a fluid receiving space and a bottle neck, and a dip tube according to claim 1, the dip tube being configured to be inserted into the bottle in order to extract a fluid, in particular a medication, from the bottle.

11. The administration system according to claim 10, further comprising a suction device having a connecting element adapted to be connected to the connecting port of the dip tube adapter.

12. A dip tube for extracting a fluid from a bottle, the dip tube comprising:

an adapter configured to be at least partially inserted into a bottle neck of the bottle and being provided with a connecting port which is configured to be connected to a suction device, an elongated hollow withdrawal tube which has a cross-sectional area that is smaller than a cross-sectional area of the adapter and which is configured to protrude from the adapter into a fluid receiving space of the bottle, when the adapter is inserted in the bottle neck, and which is arranged in fluid communication with the connecting port of the adapter, and a sealing disc extending from an outer circumferential surface of the elongated hollow withdrawal tube and being configured to abut against an inner surface of the bottle so as to seal the fluid receiving space of the bottle, wherein a spillage channel is formed in the adapter, the spillage channel having an access opening formed in a surface of the adapter which faces away from the bottle when the adapter is inserted in the bottle neck.

13. The dip tube according to claim 12, wherein the spillage channel extends around the connecting port of the adapter.

14. The dip tube according to claim 12, wherein the elongated hollow withdrawal tube comprises a first portion which faces the adapter and a second portion which faces away from the adapter, an outer dimension of the first portion being larger than an outer dimension of the second portion and/or a wall thickness of the first portion being larger than a wall thickness of the second portion.

15. The dip tube according to claim 12, wherein the dip tube is designed in the form of a one-piece component and/or wherein the dip tube is made of polyolefine, in particular low density polyethylene.

16. An administration system, comprising: a bottle having a fluid receiving space and a bottle neck, and a dip tube according to claim 12, the dip tube being configured to be inserted into the bottle in order to extract a fluid, in particular a medication, from the bottle.

17. A dip tube for extracting a fluid from a bottle, the dip tube comprising:

an adapter configured to be at least partially inserted into a bottle neck of the bottle and being provided with a connecting port which is configured to be connected to a suction device, an elongated hollow withdrawal tube which has a cross-sectional area that is smaller than a cross-sectional area of the adapter and which is configured to protrude from the adapter into a fluid receiving space of the bottle, when the adapter is inserted in the bottle neck, and which is arranged in fluid communication with the connecting port of the adapter, and a sealing disc extending from an outer circumferential surface of the elongated hollow withdrawal tube and being configured to abut against an inner surface of the bottle so as to seal the fluid receiving space of the bottle, wherein the adapter is provided with a vent hole which is configured to establish a venting path between the fluid receiving space of the bottle and an ambient atmosphere, wherein the vent hole extends from an end face of the adapter which faces the elongated hollow withdrawal tube to a bottom surface of a spillage channel formed in the adapter.

18. The dip tube of claim 17, wherein the spillage channel has an access opening formed in a surface of the adapter which faces away from the bottle when the adapter is inserted in the bottle neck.

19. The dip tube according to claim 17, wherein the elongated hollow withdrawal tube comprises a first portion which faces the adapter and a second portion which faces away from the adapter, an outer dimension of the first portion being larger than an outer dimension of the second portion and/or a wall thickness of the first portion being larger than a wall thickness of the second portion.

20. The dip tube according to claim 17, wherein the dip tube is designed in the form of a one-piece component and/or wherein the dip tube is made of polyolefine, in particular low density polyethylene.

21. An administration system, comprising: a bottle having a fluid receiving space and a bottle neck, and a dip tube according to claim 17, the dip tube being configured to be inserted into the bottle in order to extract a fluid, in particular a medication, from the bottle.

* * * * *